US005572231A

United States Patent [19]

Kobori

[11] Patent Number: 5,572,231

[45] Date of Patent: Nov. 5, 1996

[54] DRIVE DEVICE FOR IMAGE DISPLAY DEVICE

[75] Inventor: Yoichi Kobori, Mobara, Japan

[73] Assignee: Futaba Denshi Kogyo Kabushiki Kaisha, Mobara, Japan

[21] Appl. No.: 265,157

[22] Filed: Jun. 24, 1994

[30] Foreign Application Priority Data

Jun. 25, 1993 [JP] Japan ..... 5-177560

[51] Int. Cl.[6] ..... G09G 3/10

[52] U.S. Cl. ..... 345/74; 345/208

[58] Field of Search ..... 345/74, 75, 76, 345/208, 209, 211, 212, 213, 60, 30, 78; 315/169.1, 169.3, 169.4

[56] References Cited

U.S. PATENT DOCUMENTS

| | | | |
|---|---|---|---|
| 3,889,151 | 6/1975 | Hanak et al. | 345/76 |
| 4,665,345 | 5/1987 | Shionoya et al. | 345/67 |
| 4,801,920 | 1/1989 | Ohba et al. | 345/78 |
| 4,924,148 | 5/1990 | Schwartz | 345/60 |
| 5,157,309 | 10/1992 | Parker et al. | 345/76 |
| 5,231,387 | 7/1993 | Clerc | 345/76 |
| 5,762,698 | 11/1993 | Dunham | 345/30 |

*Primary Examiner*—Richard Hjerpe
*Assistant Examiner*—Steven J. Saras
*Attorney, Agent, or Firm*—Oblon, Spivak, McClelland, Miaer & Neustadt, P.C.

[57] ABSTRACT

A drive device for a field emission cathode capable of driving an image display device at a high speed while preventing leakage luminescence. A plurality of gate electrodes and cathode electrodes which are arranged in a matrix-like manner are scanned to drive an image display device. A leading edge of a drive pulse for driving the cathode electrodes in turn is defined to be a precharge period, during which a precharge pulse of a level $V_{CH}$ which does not permit emission of electrodes from emitter arrays is added. During the precharge, the gate electrodes are subject to blanking by a blanking pulse. This results the cathode electrodes being driven, followed by precharging, so that the cathodes may be driven at an increased speed while preventing leakage luminescence.

2 Claims, 6 Drawing Sheets

DRIVE DEVICE FOR IMAGE DISPLAY DEVICE

BACKGROUND OF THE INVENTION

This invention relates to a drive device for an image display device including scan electrodes arranged in a matrix-like manner, and more particularly to a drive device suitable for use for an image display device including field emission cathodes.

Application of an electric field as high as $10^9$ V/m to a surface of a metal or semiconductor material leads to a tunnel effect which permits electrons to pass through a barrier, resulting in electrons being discharged to a vacuum atmosphere even at a normal temperature. In the art, such a phenomenon is referred to as "field emission" and a cathode which is adapted to emit electrons based on such a principle is referred to as "field emission cathode" (hereinafter also referred to as "FEC").

Recently, semiconductor processing techniques have permitted a field emission cathode of the surface discharge type to be formed of arrays of field emission cathodes of a size as small as microns, leading to research and development of an image display device which has such field emission cathodes incorporated therein.

Now, a so-called Spindt-type field emission cathode which is an example of a field emission cathode produced by such semiconductor processing techniques will be described hereinafter with reference to FIG. 3. The FEC includes a cathode electrode 100 made of a metal material such as aluminum or the like and formed on a substrate 102 of glass or the like by vapor deposition. The cathode electrode 100 is formed thereon with a plurality of emitters 104 of a conical shape each made of metal such as molybdenum or the like.

The cathode electrode 100 is formed on a portion thereof on which the emitters 104 are not arranged with a film 106 of silicon dioxide ($SiO_2$), which is then formed thereon with a gate 108. The gate 108 and $SiO_2$ film 106 are formed with a plurality of through-holes, in which the emitters 104 are positioned while being mounted on the cathode electrode 100. Thus, the emitters 104 each are exposed at a tip end thereof via each of the through-holes of the gate 104.

The emitters 104 of a conical shape may be arranged so as to be spaced from each other at pitches as small as 10 microns or less, so that such emitters as many as tens of thousands to hundreds of thousands may be arranged on the single substrate 102.

Also, the semiconductor processing techniques permit the gate 108 and emitters 104 to be arranged with respect to each other while keeping a distance between the gate 108 and the tip of each of the emitters 104 smaller than a micron, so that application of a voltage $V_{GE}$ as low as only tens volts between the gate 108 and the emitters 104 permits the emitters to field-emit electrons therefrom. Then, an anode is arranged in a manner to be spaced from and opposite to the gate 108 and has a positive voltage $V_A$ applied thereto, so that electrons field-emitted from the emitters may be captured by the anode.

The FEC thus constructed has such anode current Ia/gate-emitter voltage $V_{GE}$ characteristics as shown in FIG. 4. More particularly, a gradual increase in voltage $V_{GE}$ between the gate and the emitters causes the anode current $I_A$ to start to flow through the anode. The voltage $V_{GE}$ at which flowing of the anode current $I_A$ starts is called a threshold voltage $V_{TH}$. This causes an electric field between the gate and the emitters to be about $10^9$ V/m, resulting in the emitters starting to emit electrons, so that the anode current $I_A$ starts to flow through the anode. In general, a voltage indicated at $V_{OP}$ in FIG. 4 which is considerably higher than the threshold voltage $V_{TH}$ is kept applied between the gate and the emitters, so that the anode current is kept at a level of $I_l$.

An anode current generated from each of the cone-like emitters is as small as about 1 microampere. Thus, in order to obtain an anode current of a desired increased level, the conventional FEC is so constructed that the emitters are arranged in an array manner.

Arrangement of phosphors on the anode permits electrons field-emitted from the emitters to be impinged on the phosphors when they are captured by the anode, so that the phosphors may emit light. This permits the FEC to be used for an image display device.

Now, a conventional drive circuit for driving an image display device constructed in accordance with the principle described above will be described hereinafter with reference to FIGS. 5 and 6, wherein FIG. 5 shows the drive circuit and FIG. 6 shows waveforms obtained in an operation of the drive circuit.

In the drive circuit shown in FIG. 5, serial gate data are fed to a shift register 50 and then converted into parallel gate data therein, followed by being latched by a latch circuit 51. For this purpose, the shift register 50 has a clock CLK for shift and a clear pulse CLR for clearing the shift register 50 at intervals of a predetermined period input thereto.

The gate data latched by the latch circuit 51 are applied to gate drivers 52-1 to 52-m, respectively. Gate electrodes 53-1 to 53-m each are formed into a stripe-like shape and the gate drivers 52-1 to 52-m successively drive gate electrodes (G1) 53-1 to (Gm) 53-m, respectively.

The data thus applied to the gate electrodes 53-1 to 53-m act as image data. More particularly, the data are used as image data for every cycle T as indicated at G1 to Gm in FIG. 6.

Series cathode data for successively scanning and driving cathode electrodes 57-1 to 57-n are applied to a shift register 54 and then converted into parallel cathode data therein, followed by being latched by a latch circuit 55. For this purpose, the shift register 50 has a clock CLK for shift and a clear pulse CLR for clearing the shift register 54 at intervals of a predetermined period input thereto.

The cathode data latched by the latch circuit 51 are then applied to the cathode drivers 56-1 to 56-n, respectively. Cathode electrodes 56-1 to 56-n are formed into a stripe-like shape and driven by the cathode electrodes (K1) 57-1 to (Kn) 57-n in turn, respectively.

Drive signals respectively applied to the cathode electrodes 57-1 to 57-n each are sequence pulses as indicated K1 to Kn in FIG. 6, have a pulse width T and are generated at a cycle nT.

The gate electrodes 53-1 to 53-m and cathode electrodes 57-1 to 57-n are arranged so as to constitute a matrix in cooperation with each other and emitter arrays E11, E12 - - - E21, E22 - - - Enm are formed on the cathode electrodes 57-1 to 57-n so as to be positioned at intersections between the gate electrodes 53-1 to 53-m and the cathode electrodes 57-1 to 57-n. The emitter arrays E11 to Enm thus arranged constitute picture cells of the image display device. The emitter arrays E11 to E13 in which a predetermined voltage is applied between one of the cathode electrodes 57-1 to 57-n subsequently driven by the drive signals or scan pulse signals K1 to Kn and the gate electrodes 53-1 to 53-m are thus caused to emit electrons, which are then captured by an anode (not shown) arranged above the gate electrodes 53-1 to 53-m in a manner to be spaced therefrom.

The anode has phosphors deposited thereon, so that electrons emitted from the emitter arrays E11 to Enm impinge on the phosphors positionally corresponding to the emitter arrays, resulting in the phosphors emitting light. The gate electrodes 53-1 to 53-m are applied thereto image data, so that light emission or luminescence of the phosphors is carried out depending on the image data, to thereby provide a desired luminous image.

Unfortunately, an image display device formed into a practical display size causes a stray capacitance to be increased to a level as large as 1000 pF, so that rising and falling waveforms on the cathode electrode driven are rendered gentle as shown in FIG. 6. Also, formation of the image display device into the above-described size renders a width T of a pulse for driving the cathode electrode as small as tens microseconds. Addition of gradation to a display of the device causes the width T to be further decreased to a level of hundreds nanoseconds. Thus, the above-described fact that rising and falling of the drive pulse is gentle causes the drive pulse to start rising for driving the next cathode electrode before it adequately falls.

Unfortunately, this leads to leakage luminescence of adjacent picture cells and a failure to increase a speed of a frequency of the drive pulse. Such disadvantages are remarkably caused when the image display device displays a moving image or animation.

SUMMARY OF THE INVENTION

The present invention has been made in view of the foregoing disadvantage of the prior art.

Accordingly, it is an object of the present invention to provide a drive device for an image display device which is capable of driving the image display device with a significantly increased speed.

It is another object of the present invention to provide a drive device for an image display device which is capable of effectively preventing leakage luminescence of the image display device.

In accordance with the present invention, a drive device for an image display device is provided. The drive device includes a plurality of stripe-like gates and a plurality of stripe-like cathodes which are arranged so as to form a matrix by cooperation with each other and emitters arranged on the cathodes so as to be positioned at intersections between the gates and the cathodes on the matrix. The emitters field-emits electrons by application of a predetermined voltage between the gates and the cathodes. The drive device also includes an anode upwardly spaced from the gates for capturing electrons emitted from the emitters and phosphors arranged on the anode. The cathodes are successively driven and scanned by a drive pulse and the gates each have an image signal applied thereto, resulting in luminescence of the phosphors for display of an image. The drive pulse has a leading edge defined to be a precharge period during which the cathodes are precharged. The image signal applied to each of the gates is subject to blanking during the precharge period.

In a preferred embodiment of the present invention, the drive pulse is kept at a level in proximity to a threshold level between the gates and the cathodes at which the emitters start to emit electrons and below the threshold level.

In the present invention constructed as described above, the cathodes are driven after being subject to precharge, so that a period of time required for rising is reduced to permit the gates to be driven at a high speed. Also, the cathodes are subject to blanking during the precharge period, to thereby prevent leakage luminescence.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, wherein.

DETAILED DESCRIPTION OF THE PREFERRED EMBODIMENT

Now, a drive device for an image display device according to the present invention will be described hereinafter with reference to the accompanying drawings.

Figure 1:
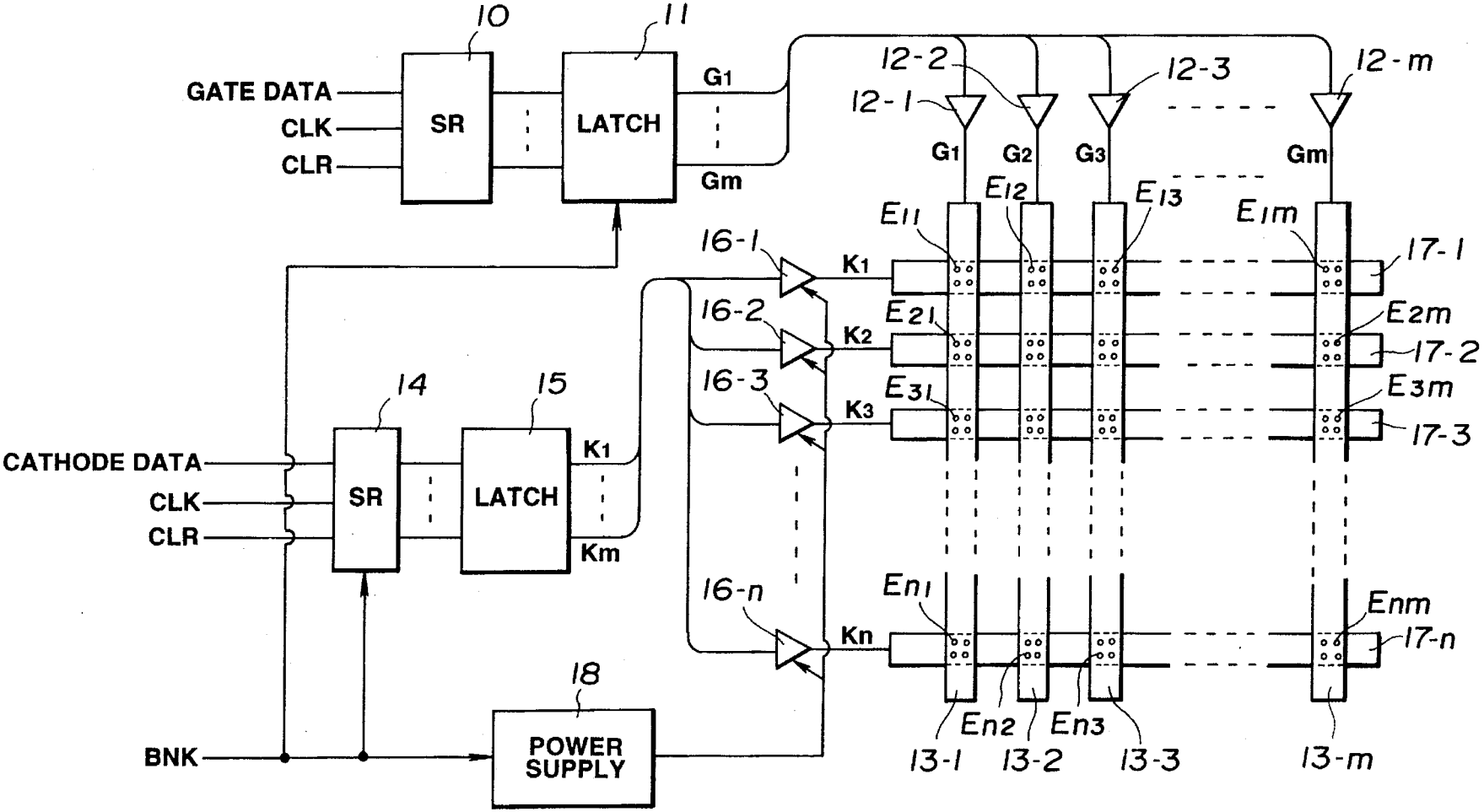
FIG. 1 is a block diagram showing an embodiment of a drive device for an image display device according to the present invention.
Figures 2A, 2B, 2C, 2D, 2E, 2F:
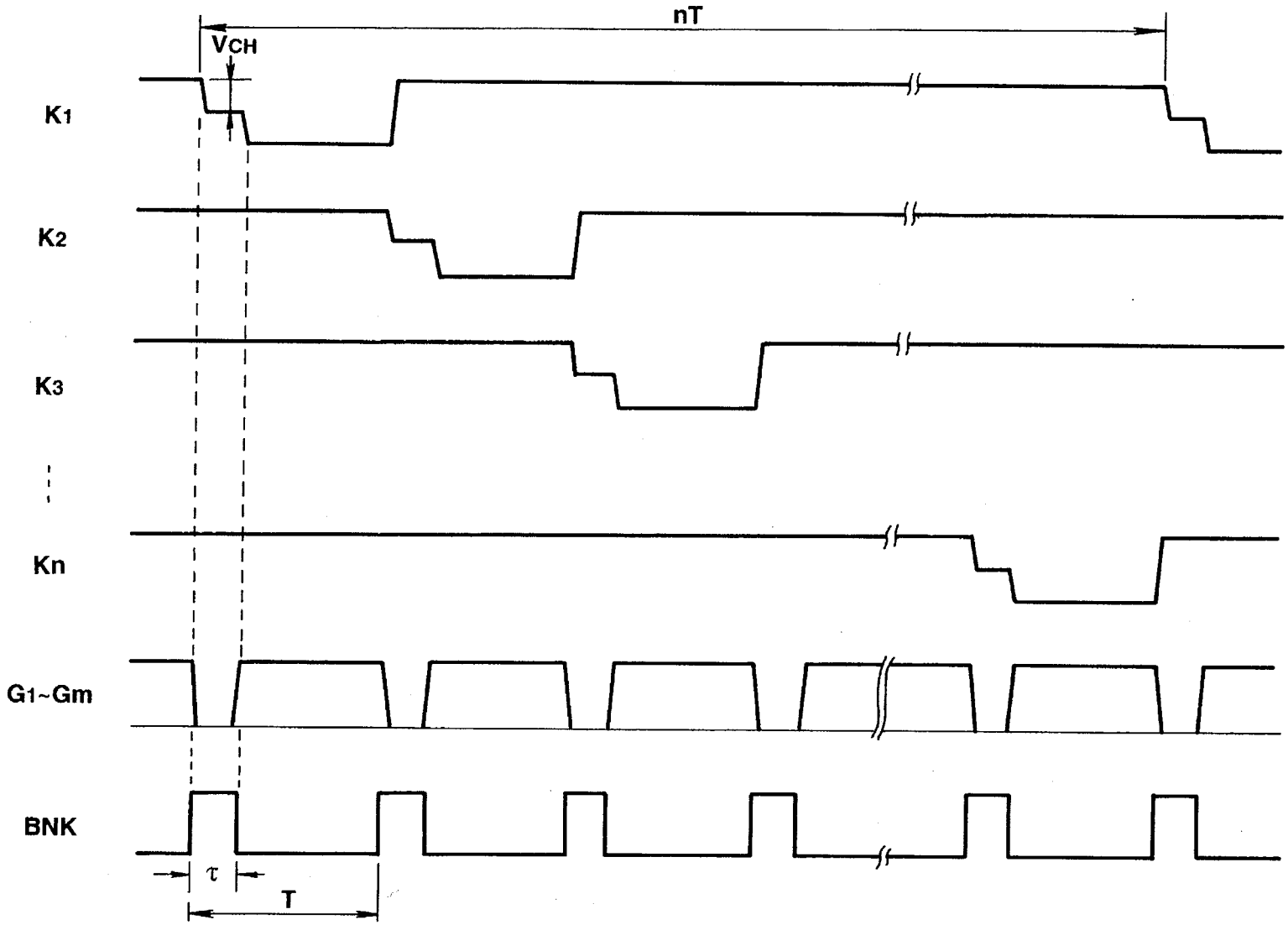
FIG. 2 is a waveform chart showing waveforms obtained in an operation of the drive device of FIG. 1.
Figure 3:
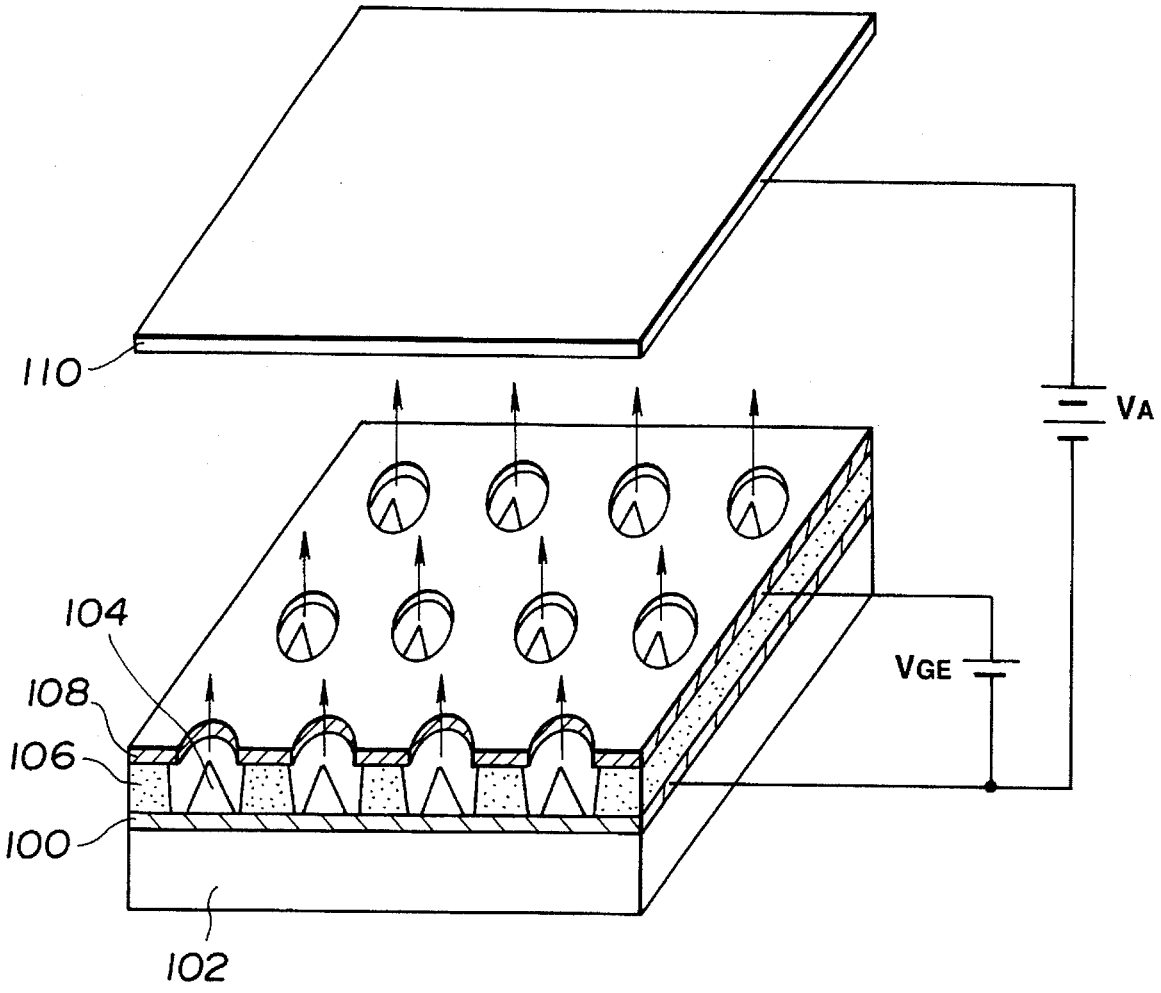
FIG. 3 is a perspective view showing a field emission cathode of the Spindt type.

Referring first to FIGS. 1 and 2, an embodiment of a drive device for an image display device according to the present invention is illustrated. A drive device of the illustrated embodiment, as shown in FIG. 1, is so constructed that serial gate data are fed to a shift register 10 and then converted into parallel gate data therein. The parallel gate data thus obtained are then latched by a latch circuit 11. For this purpose, the shift register 10 is applied thereto a clock CLK for shift and a clear pulse CLR for clearing the shift register 10 at intervals of a predetermined period.

The gate data latched by the latch circuit 11 are applied to gate drivers 12-1 to 12-m, respectively. Gate electrodes 13-1 to 13-m are formed into a stripe-like shape and the gate drivers 12-1 to 12-m drive the gate electrodes (G1) 13-1 to (Gm) 13-m in turn, respectively.

The latch circuit 11 is applied thereto a blanking pulse BNK as shown in FIGS. 1 and 2, during which an output of the latch circuit 11 is interrupted. This results in application of the gate data to be gate electrodes 13-1 to 13-m being prevented during a blanking pulse period for which the blanking pulse BNK is applied to the latch circuit 11.

Figures 6A, 6B, 6C, 6D, 6E:
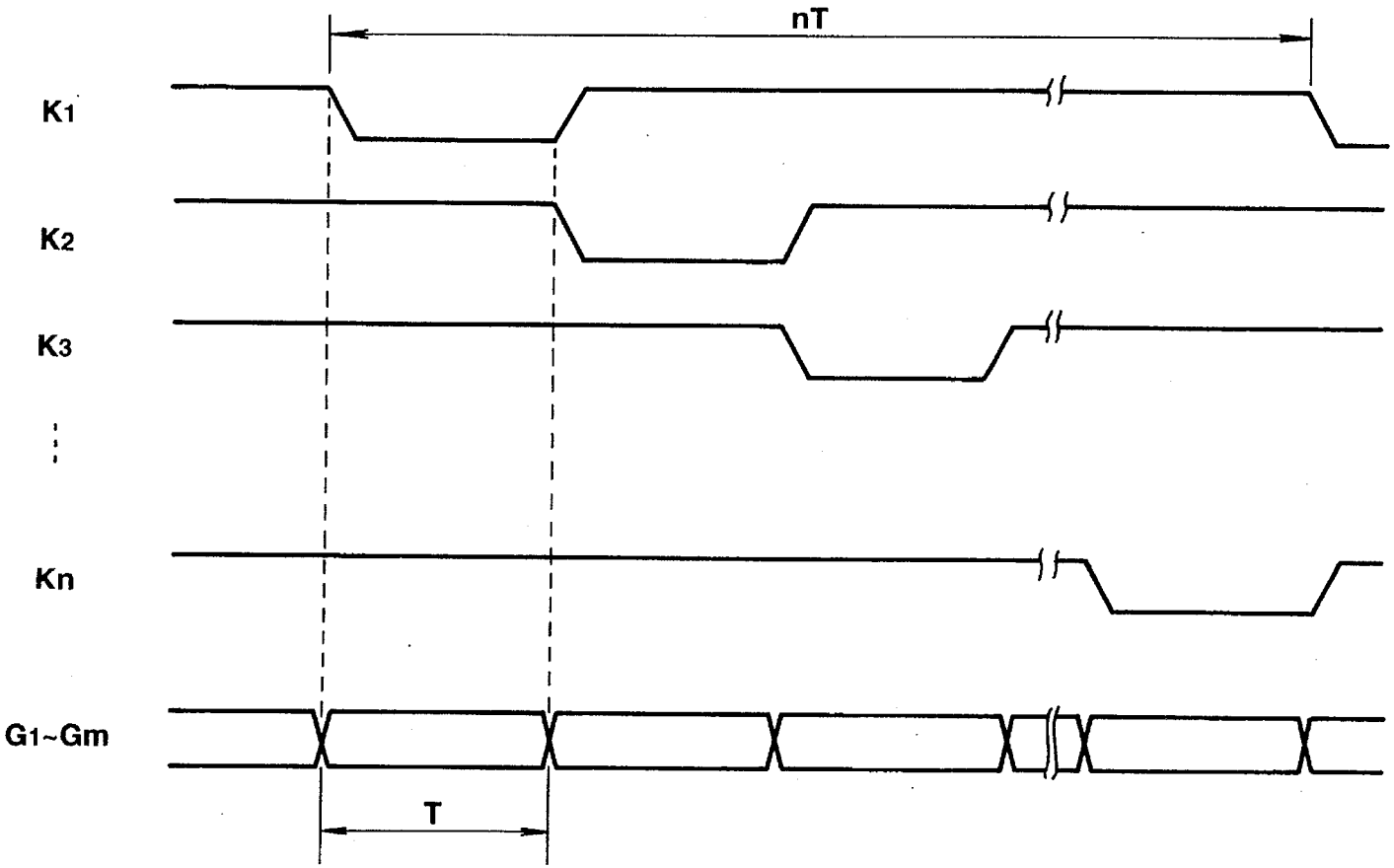
FIG. 6 is a waveform chart showing wave forms obtained in an operation of the conventional drive device of FIG. 5.

The data applied to the gate electrodes 13-1 to 13-m are adapted to function as image data, so that image data which are subject to blanking during the blanking pulse period for which the blanking pulse is applied to the latch 11 are applied to the gate electrodes 13-1 to 13-m at every cycle T, as indicated at G1 to Gm in FIG. 6.

Serial cathode data for scanning and driving cathode electrodes 17-1 to 17-n in turn are applied to a shift register 14 and then converted into parallel cathode data therein, followed by being latched in a latch circuit 15. For this purpose, the shift register 14 has a clock CLK for shift and a clear pulse CLR for clearing the shift register 14 at intervals of a predetermined period applied thereto.

The cathode data latched by the latch circuit 15 are then applied to cathode drivers 16-1 to 16-n, respectively. The cathode electrodes 17-1 to 17-n each are formed into a stripe-like shape and the cathode drivers 16-1 to 16-n drive the cathode electrodes (K1) 17-1 to (Kn) 17-n in turn, respectively.

Figure 4:
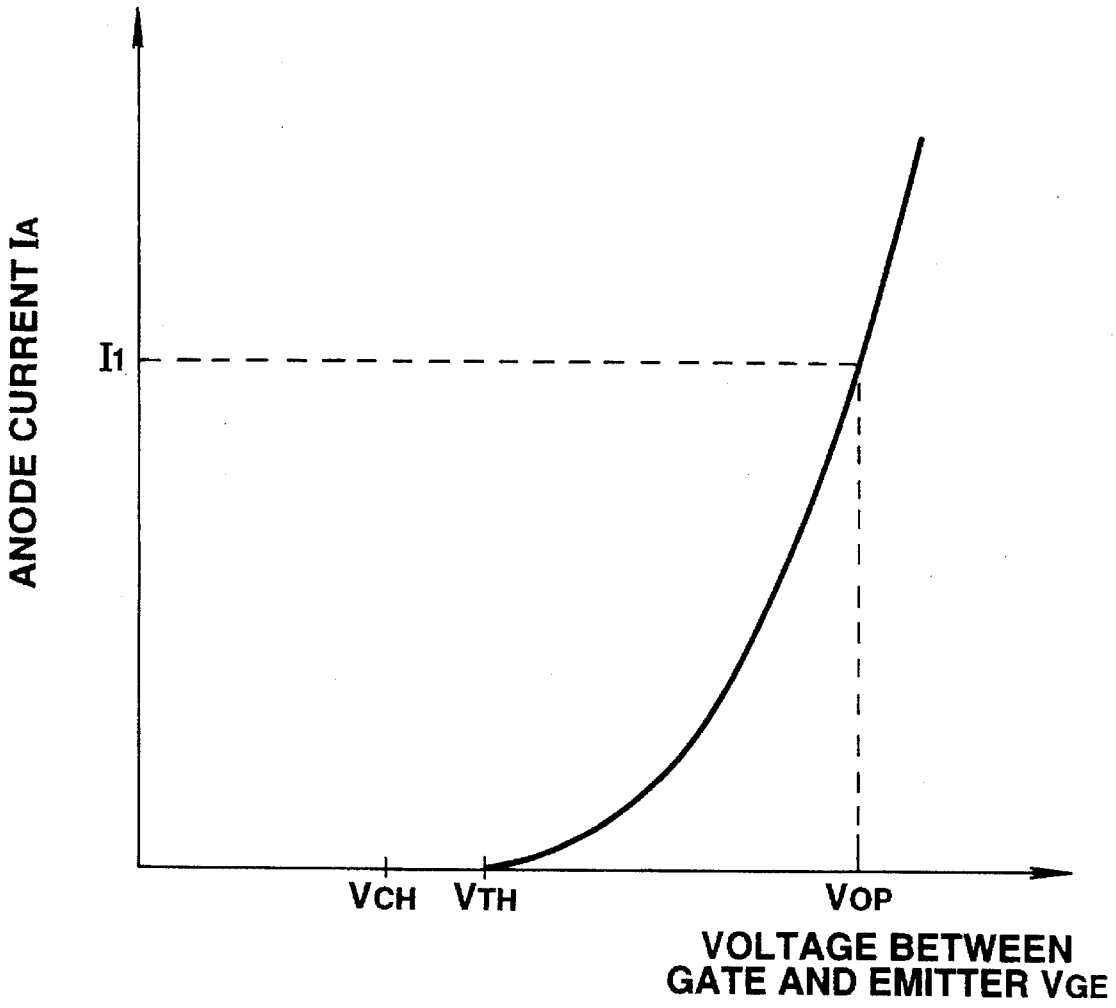
FIG. 4 is a graphical representation showing anode current/gate-emitter voltage characteristics in a field emission cathode.
Figure 5:
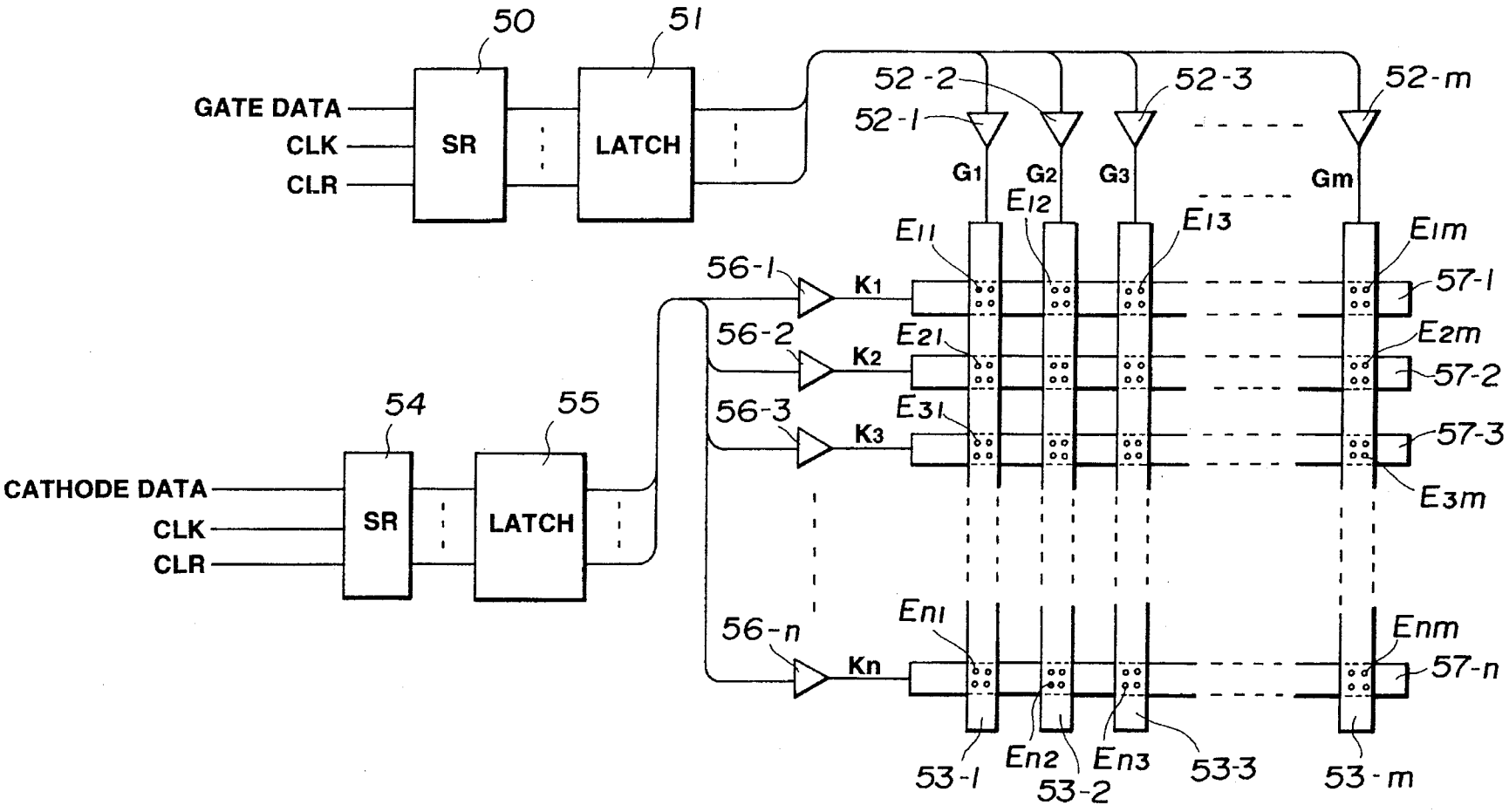
FIG. 5 is a block diagram showing a conventional drive device for an image display device.

The above-described blanking pulse BNK is applied to the shift register 14, as well as to the drive circuits 16-1 to 16-n through a power supply 18. This results in a pulse of a level $V_{CH}$ being output from each of the drive circuits 16-1 to 16-n during a blanking pulse period for which the blanking pulse BNK is applied to the drive circuits 16-1 to 16-n. The level $V_{CH}$ is set to be lower than a threshold $V_{TH}$ as shown in FIG. 4. The blanking pulse is formed into a pulse width $\tau$.

During the period $\tau$ for which the pulse of the level $V_{CH}$ is generated from each of the drive circuits 16-1 to 16-n, the pulse causes each of the cathode electrodes 17-1 to 17-n to be precharged. This causes each of the cathode electrodes 17-1 to 17-n to rise after it is precharged to the level $V_{CH}$, to thereby reduce a period of time required for the rising, resulting in increasing a speed of a drive frequency. Drive pulses associated at this time are sequence pulses to which a precharge pulse for precharging each of the cathode electrodes is added during the period $\tau$, as indicated at K1 to Kn in FIG. 2. The drive pulses each have a pulse width T and generated at a cycle nT.

Also, as shown in FIG. 1, the gate electrodes 13-1 to 13-m and cathode electrodes 17-1 to 17-n are arranged so as to form a matrix in cooperation with each other and emitter arrays E11, E12 - - - E21, E22 - - - Enm are formed on the cathode electrodes 17-1 to 17-n so as to be positioned at intersections between the gate electrodes 13-1 to 13-m and the cathode electrodes 17-1 to 17-n. The emitter arrays E11 to Enm thus arranged provide picture cells of the image display device. Thus, the emitter arrays E11 to Enm in which a predetermined voltage is applied between the gate electrodes 13-1 to 13-m and one of the cathode electrodes 17-1 to 17-n driven by the scan pulse signals K1 to Kn are cause to emit electrons, which are then captured by an anode (not shown) arranged above the gate electrodes 13-1 to 13-m in a manner to be spaced therefrom.

The anode has phosphors deposited thereon, so that electrons emitted from the emitter arrays E11 to Enm each acting as a picture cell are impinged on the phosphors corresponding to the emitter arrays, leading to light emission or luminescence of the phosphors. The gate electrodes 13-1 to 13-m, as described above, are applied thereto the image data, so that luminescence of the phosphors is carried out depending on the image data, resulting in providing a luminous image display.

In the illustrated embodiment, the pulses of the level $V_{CH}$ are kept applied to the cathode electrodes while the blanking pulse BNK is applied to the drive circuits 16-1 to 16-n, during which the signal applied to each of the gate electrodes 13-1 to 13-m is subject to blanking, so that a voltage between the gate electrodes and the emitters is caused to have the level $V_{CH}$. This effectively prevents emission of electrons from the emitter arrays, to thereby prevent leakage luminescence from adjacent picture cells.

Also, the embodiment is so constructed that the power supply 18 is arranged for generating the precharge pulse. However, the present invention is not limited to such a construction. For example, the precharge voltage $V_{CH}$ may be provided by means of a voltage dividing resistor. Also, it is merely required to carry out the precharge for a period of time during which the voltage of the cathode electrodes is increased to the level $V_{CH}$, so that it may be varied depending on a stray capacitance of the cathode electrodes.

As can be seen from the foregoing, the drive device of the present invention permits the cathode electrodes to be driven after being precharged, to thereby increase in speed of the drive pulse. Also, the present invention is constructed so as to subject the gate electrodes to blanking during the precharge, to thereby prevent leakage luminance of adjacent picture cells, resulting in displaying a distinct animation.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A drive device for an image display device including a plurality of stripe-like gate electrodes and a plurality of stripe-like cathode electrodes which are arranged so as to form a matrix by cooperation with each other, emitters arranged on said cathode electrodes so as to be positioned at intersections between said gate electrodes and said cathode electrodes on said matrix, said emitters field-emitting electrons by application of a predetermined voltage between said gate electrodes and said cathode electrodes, and an anode upwardly spaced from said gates for capturing electrons emitted from said emitters, said drive device comprising:

means for successively driving said cathode electrodes by a drive pulse so as to scan said cathode electrodes;

means for applying an image signal to each of said gate electrodes, resulting in luminescence of said phosphors for display of an image;

means for applying a precharge voltage to the cathode electrodes prior to application of said drive pulse in a precharge period during which said cathode electrodes are precharged; and means for blanking application of said image signal applied to each of said gate electrodes during said precharge period to prevent said image signal from being applied to said gate electrodes during said precharge period.

2. A drive device as defined in claim 1, wherein said drive pulse is kept at a level in proximity to a threshold level between said gate electrodes and said cathode electrodes at which said emitters start to emit electrons and below said threshold level.

* * * * *